US007716884B2

(12) United States Patent
Jaycox

(10) Patent No.: US 7,716,884 B2
(45) **Date of Patent: *May 18, 2010**

(54) SHUTTER ASSEMBLY

(75) Inventor: Jeffrey Jaycox, Virginia Beach, VA (US)

(73) Assignee: Tapco International Corporation, Wixom, MI (US)

( * ) Notice: Subject to any disclaimer, the term of this patent is extended or adjusted under 35 U.S.C. 154(b) by 849 days.

This patent is subject to a terminal disclaimer.

(21) Appl. No.: 11/458,601

(22) Filed: Jul. 19, 2006

(65) Prior Publication Data

US 2006/0242919 A1 Nov. 2, 2006

Related U.S. Application Data

(63) Continuation-in-part of application No. 10/264,477, filed on Oct. 4, 2002, now Pat. No. 7,062,884.

(60) Provisional application No. 60/404,016, filed on Aug. 16, 2002.

(51) Int. Cl.
*E06B 1/60* (2006.01)

(52) U.S. Cl. ..... 52/203; 52/202; 52/DIG. 12; 52/204.68; 49/394; 49/387; 403/231

(58) Field of Classification Search ..... 52/203, 52/202, DIG. 12, 127.8, 656.9, 285.4, 285.2, 52/283; 403/387, 232.1, 231, 234; 49/394, 49/56; 211/4; 248/159; 292/288, 298, 297, 292/DIG. 15

See application file for complete search history.

(56) References Cited

U.S. PATENT DOCUMENTS 656,275 A 8/1900 Streeter
729,445 A 5/1903 Streeter
787,641 A * 4/1905 Robinson ..... 49/56
1,465,443 A * 8/1923 Josler ..... 49/56
1,526,536 A * 2/1925 Elliott ..... 49/56
1,834,421 A 12/1931 Rawson
2,091,706 A * 8/1937 Flint ..... 49/67
2,221,005 A 11/1940 Reese
2,603,822 A * 7/1952 Evans ..... 16/263
2,868,281 A * 1/1959 Crimboli ..... 160/92
2,963,753 A 12/1960 Seaburg
3,183,547 A * 5/1965 Bury ..... 16/238

(Continued)

FOREIGN PATENT DOCUMENTS

FR 2682424 4/1993

(Continued)

*Primary Examiner*—Phi Dieu Tran A
(74) *Attorney, Agent, or Firm*—Howard & Howard Attorneys PLLC

(57) ABSTRACT

A shutter assembly having at least one shutter and a security bar device for locking closed and providing additional rigidity to the shutter when covering an opening in a dwelling. The bar device has an elongated member preferably engaged releasably to the dwelling in the opening. The member traverses the opening and prevents the shutters from collapsing into the opening when closed. A retention bracket co-extends with and is spaced from the member with a portion of the shutter layered there-between when in the closed position. As such, the retention bracket prevents the shutter from opening when in the closed position. A locking portion of the retention bracket projects laterally to releasably engage the member.

15 Claims, 4 Drawing Sheets

U.S. PATENT DOCUMENTS

| | | | | | |
|---|---|---|---|---|---|
| 3,612,461 | A | | 10/1971 | Brown | |
| 4,193,235 | A | | 3/1980 | Cucchiara | |
| 4,384,428 | A | * | 5/1983 | Cox | 49/56 |
| 4,408,428 | A | | 10/1983 | Brooke et al. | |
| 4,423,897 | A | | 1/1984 | Williams | |
| 4,630,396 | A | * | 12/1986 | Zvi et al. | 49/55 |
| 4,655,003 | A | * | 4/1987 | Henley, Sr. | 49/87.1 |
| 4,905,952 | A | | 3/1990 | Pinquist | |
| 4,938,154 | A | | 7/1990 | Watt | |
| 5,077,951 | A | | 1/1992 | Baker | |
| 5,368,324 | A | | 11/1994 | Kaim | |
| 5,428,930 | A | | 7/1995 | Bagley et al. | |
| 5,540,018 | A | | 7/1996 | Biggers | |
| 5,852,903 | A | * | 12/1998 | Astrizky | 52/202 |
| 6,089,300 | A | | 7/2000 | Woodside et al. | |
| 6,125,905 | A | | 10/2000 | Woodside et al. | |
| 6,131,354 | A | | 10/2000 | Thompson | |
| 6,296,039 | B1 | | 10/2001 | Mullet et al. | |
| 6,341,639 | B1 | | 1/2002 | Mullet et al. | |
| 6,393,777 | B1 | | 5/2002 | Renfrow | |
| 6,408,592 | B1 | | 6/2002 | Hourani | |
| 6,865,846 | B2 | * | 3/2005 | Hsu | 49/74.1 |
| 2004/0010988 | A1 | | 1/2004 | Jaycox et al. | |

FOREIGN PATENT DOCUMENTS

| | | |
|---|---|---|
| GB | 2058897 | 4/1981 |

* cited by examiner

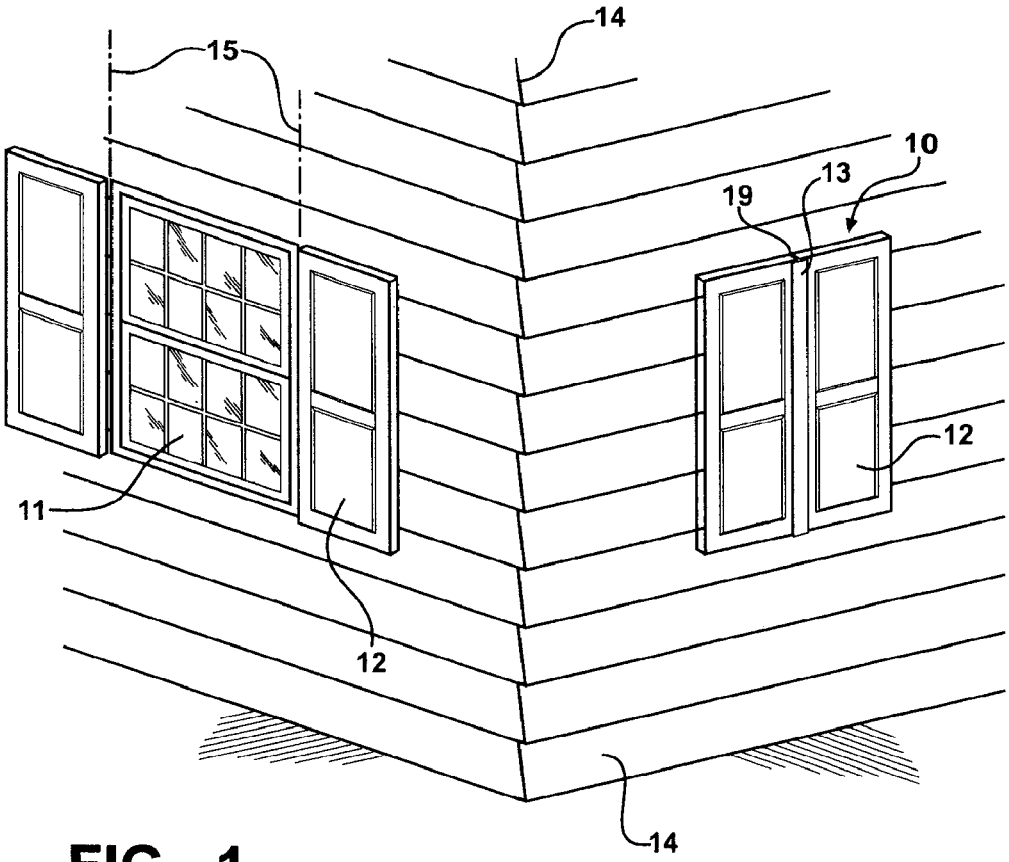
FIG - 1
FIG - 8
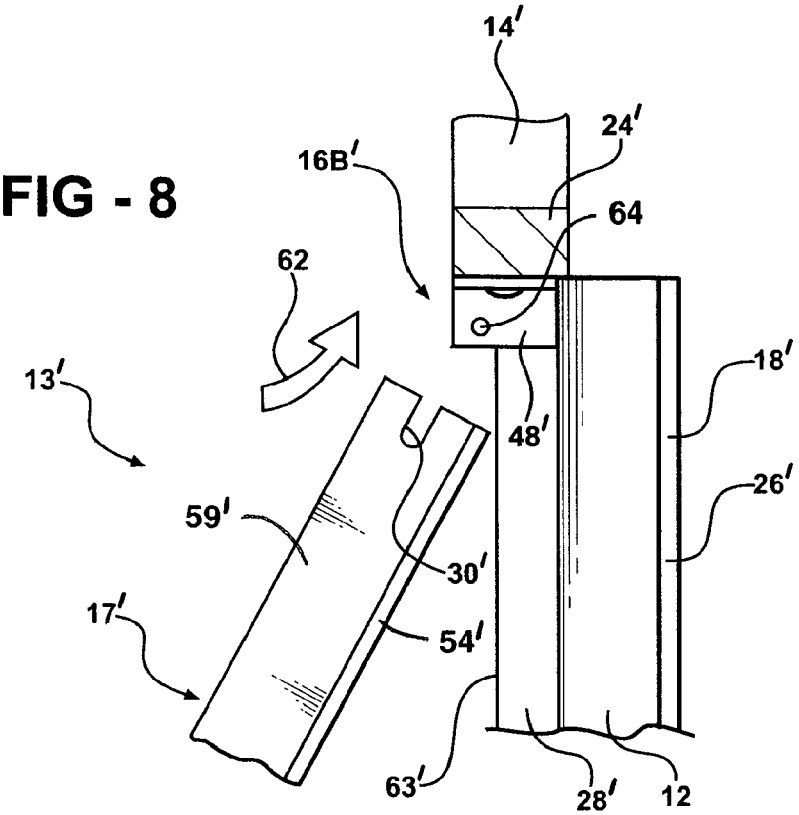

FIG - 3
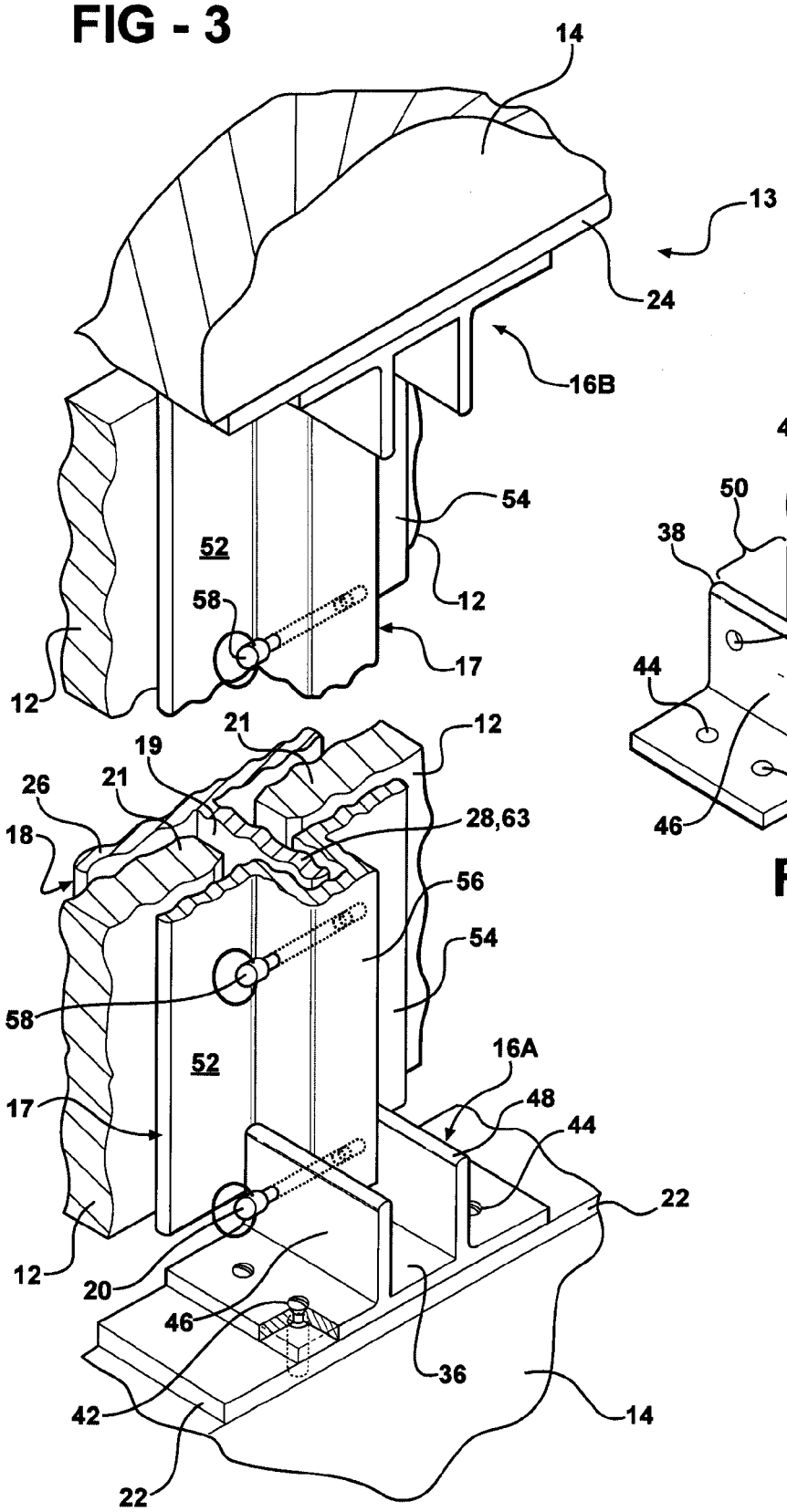
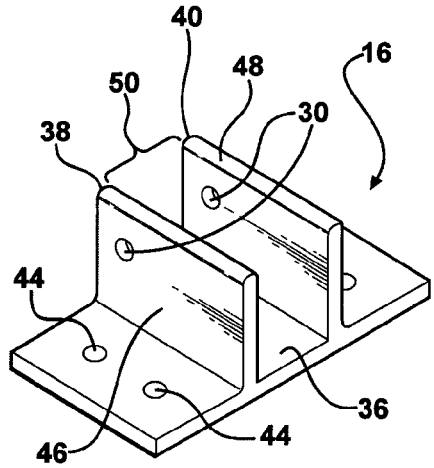
FIG - 4

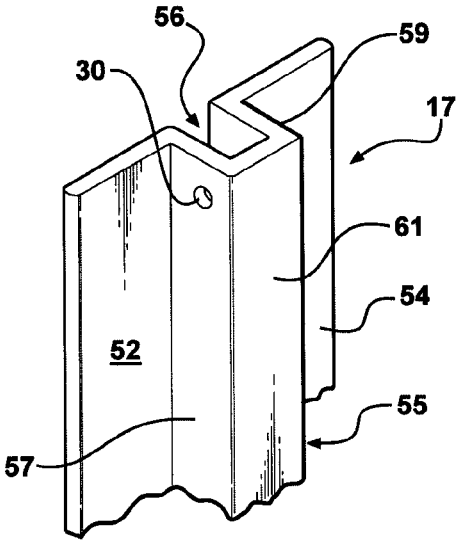
FIG - 5
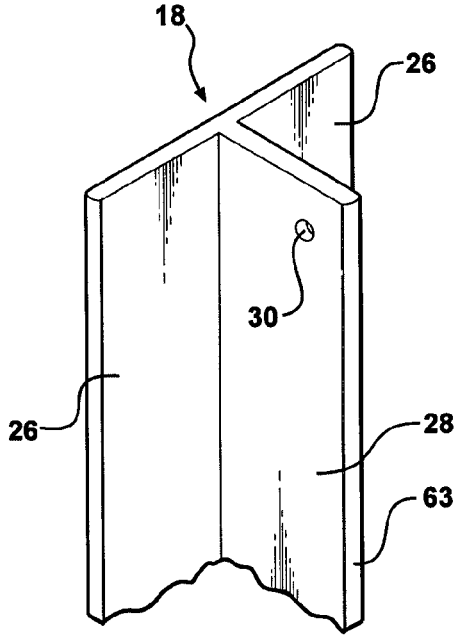
FIG - 6
FIG - 7
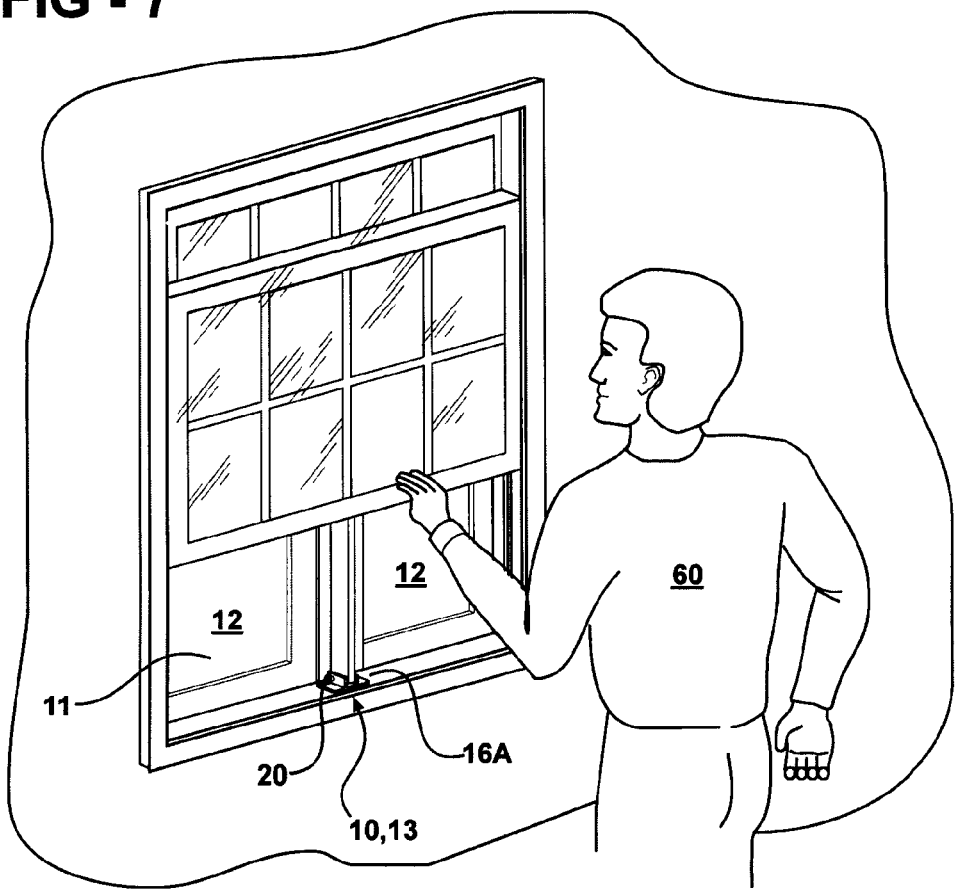

SHUTTER ASSEMBLY

RELATED APPLICATIONS

This continuation-in-part patent application claims priority to U.S. parent patent application Ser. No. 10/264,477, filed Oct. 4, 2002, now issued U.S. Pat. No. 7,062,884, issue date Jun. 20, 2006, which claims priority to U.S. provisional patent application Ser. No. 60/404,016, filed Aug. 16, 2002.

FIELD OF THE INVENTION

The subject invention generally relates to a shutter assembly and more particularly to a reinforced, locking, shutter assembly that withstands inclement weather.

BACKGROUND OF THE INVENTION

Various locking assemblies for shutters are known in the art. It is generally known that locking assemblies are utilized, when necessary, to lock pairs of shutters in a closed position on a dwelling. Shutters are used for both aesthetic and function purposes on the dwelling. In the closed position, the shutters function to protect windows, doors, and other openings of the dwelling during inclement weather, such as precipitation storms, wind storms, and hurricanes.

During such inclement weather, it is pertinent to lock, or retain, the shutters in the closed position such that the shutters can continue to provide adequate protection to the windows, doors, and other openings during and throughout the inclement weather. If the weather causes the shutters to open then the functional purpose of the shutters is defeated.

Conventional assemblies for locking pairs of shutters in the closed position are deficient for many reasons. For instance, the locking assemblies of the prior art do not adequately retain the shutters in the closed position throughout the inclement weather. In these assemblies, wind either bends or breaks the assembly and then causes the shutters to open. Also for instance, many conventional locking assemblies require direct drilling into and through the shutters to adequately retain the shutters in the closed position. In these assemblies the fastener extends through at least a portion of the shutters. As a result, to one degree or another, these conventional locking assemblies damage the shutters such that, after the inclement weather, the aesthetic purpose of the shutters is negatively impacted.

Furthermore, some conventional locking assemblies, also referred to in the art as storm or locking bars, create an emergency egress issue that prevents occupants of the dwelling from escaping during an emergency, such as a fire. More specifically, a conventional storm bar is mounted across the shutters once the shutters have been closed. The storm bar is secured, typically screwed, into the dwelling on each side of the closed shutters to prevent the shutters from opening during the inclement weather. Screws are also used to connect the shutters to the storm bar such that the shutters can not be blown, or otherwise deflected, inward, i.e., toward the dwelling, during the inclement weather. With the storm bar screwed to the dwelling and the shutter screwed to the storm bar, the occupants of the dwelling cannot open a window or door from within the dwelling to release the storm bar and escape.

Due to the deficiencies in the locking assemblies of the prior art, including those described above, it is desirable to provide a novel locking assembly for shutters that adequately retains the shutters in a closed position on a dwelling such that protection to a window, door, or other opening is maximized throughout any inclement weather. It is also desirable to provide a locking assembly for shutters that does not physically damage the shutters to retain the shutters in a closed position. More specifically, it would be ideal to provide a locking assembly that retains the shutters in a closed position without a fastener extending through the shutters.

SUMMARY OF THE INVENTION AND ADVANTAGES

A shutter assembly having at least one shutter and a security bar device for locking closed and providing additional rigidity to the shutter when covering an opening in a dwelling. The bar device has an elongated member preferably releasably engaged to the dwelling in the opening. The member traverses the opening and prevents the shutters from collapsing into the opening when closed. A retention bracket co-extends with and is spaced from the member with a portion of the shutter layered there-between when in the closed position. As such, the retention bracket prevents the shutter from opening when in the closed position. A locking portion of the retention bracket projects laterally to releasably engage the member.

Preferably, the elongated member is engaged releasably to the dwelling by at least one leg of a mounting bracket that projects into the opening and engages the member at an end. The locking portion of the retaining bracket is preferably removably secured to the member at the leg utilizing a common fastener that preferably extends through aligned apertures in the leg, the retaining bracket, and the member. With the retention bracket locked to the member and leg, the shutters are retained in the closed position.

Accordingly, the subject invention provides a shutter assembly having shutters that adequately remain in a closed position on a dwelling during harsh environmental conditions to protect an opening, yet has a security bar device that can be quickly released by an occupant to open the shutters if need be. It is also advantageous that the shutters of the shutter assembly do not require unsightly modification to work with a security bar device of the assembly. Hence, fasteners used for the assembly do not visually affect or physically damage the shutters in any way. Other advantages include a relatively simple and robust design that is inexpensive to manufacture and in service has a long and useful life.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a dwelling having the shutter assembly embodying the present invention with one pair of shutters in an open position and another pair of shutters in a closed position;

FIG. 3 is a perspective view illustrating a locking assembly of the subject invention mounted to a sill of the dwelling and a locking assembly of the subject invention mounted to a header of the dwelling, both retaining the shutters in the closed position on the dwelling;

FIG. 4 is a perspective view illustrating a first backing component according to the subject invention;

FIG. 5 is a perspective view illustrating a second backing component according to the subject invention;

FIG. 6 is a perspective view illustrating a retention bracket according to the subject invention;

FIG. 7 is a perspective view illustrating an occupant of the dwelling opening a window to access the locking assembly from within the dwelling; and FIG. 8 is a partially cross-sectional side view of an alternative locking assembly according to the subject invention adapted to be mounted to the header of the window.

DETAILED DESCRIPTION OF THE PREFERRED EMBODIMENT

Figure 2:
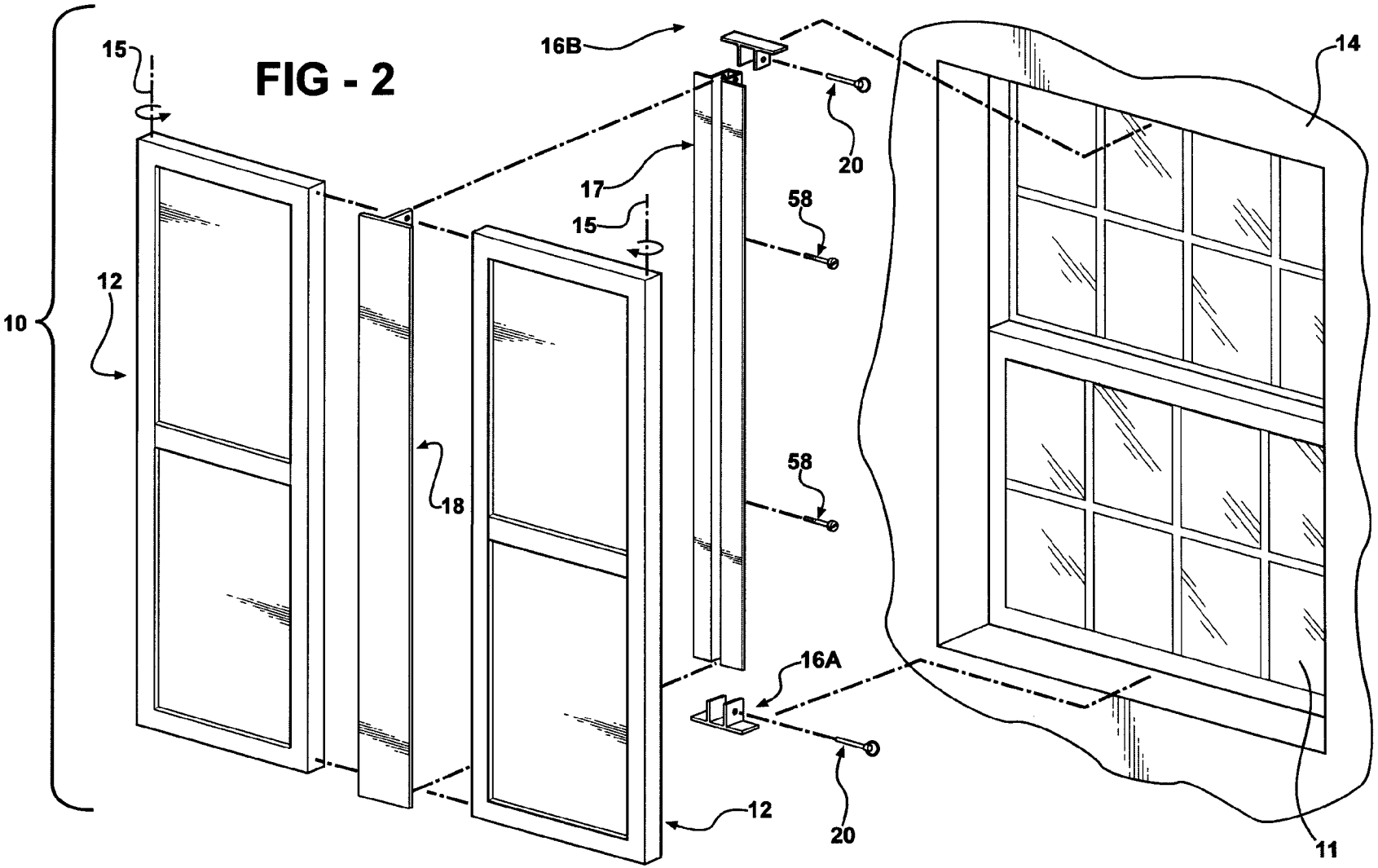
FIG. 2 is an exploded perspective view of the shutter assembly.

Referring to the Figures, wherein like numerals indicate like or corresponding parts throughout the several views, a shutter assembly is generally disclosed at 10 and mounts to a dwelling 14 such as a home or industrial building to open and close over an opening 11 in the dwelling such as a doorway or window. When closed, the shutter assembly 10 protects the windows and/or doors from inclement weather, such as precipitation storms, wind storms, and hurricanes. To accomplish this protection, the shutter assembly 10 has a lockable storm bar device 13 that reinforces and locks closed a pair of shutters 12 of the assembly 10 hinged along respective pivot axes 15 that are preferably parallel to one-another.

As best illustrated in FIGS. 2-3, the storm bar device 13 has lower and upper mounting brackets 16A, 16B, an elongated backing member 17, an elongated retention bracket 18 that generally co-extends with the backing member 17, and a plurality of quick release fasteners 20. For ease of explanation, the shutter assembly 10 will be described as if installed over the opening 11 of a window of the dwelling, however, one skilled in the art would know that such an assembly could be installed over any opening in a structure requiring protection from inclement weather. Preferably, the shutters 12 are hinged to an external surface of the dwelling 14 and swing in opposite rotational directions about respective axes 15 to close, thus forming a relatively small and substantially vertical gap 19 between distal portions 21 of the respective shutters 12 spaced radially outward from the respective axes 15. When the shutters 12 are closed, the gap 19 substantially bisects and is located in front of the opening 11 or window at the exterior of the dwelling 14.

The lower and upper mounting brackets 16A, 16B are located generally external to the window and in the opening 11 of the dwelling 14 and remain attached fixedly to the dwelling whether or not the shutters 12 are open or closed. The lower mounting bracket 16A (see FIGS. 3 and 4) attaches rigidly to a sill 22 of the window and the upper mounting bracket 16B attaches rigidly to the header 24 of the window. When the shutter assembly 10 is closed and locked, the elongated backing member 17 of the storm bar device 13 is located inside of the shutters 12 (i.e. between the shutters 12 and the window, yet inside the opening 11) and extends between and fastens to the lower and upper mounting brackets 16A, 16B. The elongated retention bracket 18 is located externally of the shutters 12 and projects laterally through the gap 19 to engage the elongated backing member 17 and preferably the brackets 16A, 16B via the quick release fasteners 20. The backing member 17 and thus the lower and upper brackets 16A, 16B are adapted to be fixedly mounted to the dwelling 14 for keeping the shutters 12 spaced from the dwelling 14 when the shutters 12 are in the closed position. That is, the backing member 17 keeps the shutters 12 in a spaced relationship relative to the dwelling 14.

Referring to FIG. 6, the retention bracket 18 is preferably a T-bar having a generally T-shaped cross section that includes a retention portion 26 and a locking portion 28 that longitudinally bisects the retention portion 26 and projects laterally there-from at a substantial right angle. When the shutters 12 are closed, the retention portion 26 is generally co-planar to the shutters 12 and the locking portion 28 extends laterally through the gap 19 between the distal portions 21 of the closed shutters 12 to secure to the backing member 17. As best shown in FIG. 3, at least the distal vertical portions 21 of the closed shutters 12 are layered snuggly between the retention portion 26 of the retention bracket 18 and the backing member 17. During inclement weather, the retention portion 26 of the retention bracket 18 prevents the shutters 12 from moving away from the dwelling 14 into an open position.

The elongated backing member 17 preferably has a U-channel section 55 having opposite side walls 57, 59 and a bottom wall 61 that extends laterally between the two side walls 57, 59. A channel 56 is defined by walls 57, 59, 61 and receives a distal edge 63 of the locking portion 28 of the retention bracket 18 that projects inward through the gap 19 and beyond the shutters 12. The U-channel section 55 is flanked on both sides by first and second lateral flange sections 52, 54 that project laterally outward and extend longitudinally along the respective side walls 57, 59. Each side wall 57, 59 extends laterally between the bottom wall 61 and respective flange sections 52, 54. When the shutter assembly 12 is closed and locked, the distal portions 21 of the respective shutters 12 are layered between the retention portion 26 of the retention bracket 18 and the respective flange sections 52, 54 of the backing member 17.

Referring more specifically to FIGS. 2-4, the lower and upper brackets 16A, 16B each have a base plate 36, a first support leg 46 and a second support leg 48. The legs 46, 48 project outward from a common side of the plate 36, are substantially parallel to one another and define a slot 50 there-between. The slot 50 is preferably opened at an outward end with respect to the dwelling 14 that is generally defined by outward lateral edges 38, 40 of respective legs 46, 48. The base plates 36 secure to the respective sill 22 and header 24 by at least one fastener or screw 42 that extend through holes 44 in the plate 36. Although not required, it is preferred that molded plastic inserts, or anchors, are disposed in the sill 22 or the header 24 to receive the fasteners. The molded plastic inserts, or anchors, are disclosed in phantom in FIG. 3.

During operation of the shutter assembly 10, and when the shutters 12 are generally open, the exterior retention bracket 18 and the interior backing member 17 are preferably removed from the dwelling 14 with only the lower and upper brackets 16A, 16B attached. Opposite ends of the backing member 17 are placed transversely into the slots 50 of the respective brackets 16A, 16B. Prior to closing the shutters 12 and prior to locking the storm bar device 13, the lower end of the backing member 17 can rest upon the base plate 36 and in the slot 50 of the lower bracket 16A. When so positioned, the flange sections 52, 54 of the backing member 17 are butted against the respective edges 38, 40 of the respective legs 46, 48 of the brackets 16A, 16B. This pre-alignment will generally assure that the channel 56 is aligned to the gap 19 and that the shutters 12 when closed will be properly spaced from the dwelling 14.

With the backing member 17 positioned, the shutters are then closed upon the flange sections 52, 54 of the backing member 17. The locking portion 28 of the retention bracket 18 is then inserted laterally through the gap 19 and into the channel 56 of the backing member 17. When so inserted, the longitudinal ends or distal corners of the locking portion 28 are located in the slots 50 of the respective mounting brackets 16A, 16B thus vertically aligning the retention bracket 18. With the retention bracket 18 in the channel 56, one of the fasteners 20 is inserted through aligned apertures 30 in the support leg 46 of the lower mounting bracket 16A, then through the first side wall 57 of the lower end of the interior backing member 17, then through the locking portion 28 of the exterior retention bracket 18, through the second sidewall 59 and then through the second support leg 48. Likewise, another fastener 20 is inserted through apertures 30, first in the leg 48 of the upper mounting bracket 16B, then through the first side wall 57 of the upper end of the interior backing member 17, then through the locking portion 28, through the second sidewall 59 and then through the support leg 46. Preferably providing further rigidity and strength to the storm bar device 13 are at least one intermediate fastener 58 that is spaced between the lower and upper mounting brackets 16A, 16B and extends through the U-channel section 55 of the member 17 and the locking portion 28 of the retention bracket 18. With the retention bracket 18 locked to the backing member 17 and the mounting brackets 16A, 16B, the shutters 12 are retained in the closed position.

When the shutter assembly 10 is fully closed and locked, the retention bracket 18 is locked to the backing member 17, and the shutters 12 are retained in the closed position without the fasteners 20 physically damaging the shutters 12 themselves. Preferably, the fastener 20 is a cotter pin. The cotter pin may include a separate locking needle or may be a more modern-type cotter pin with spring loaded bearings embedded in the cotter pin that retract upon insertion through the components (not shown). The fasteners 20 are not limited to cotter pins and may include many other types of fasteners including, but not limited to, a nut-and-bolt assembly, other locking pins, and the like.

Referring now to FIG. 7, in the event an emergency egress issue arises, such as during a fire, an occupant 60 can still exit the dwelling 14 through the window, door, or other opening even when the shutter assembly 10 is closed and locked. That is, from within the dwelling 14, the occupant 60 simply opens the window, door, etc., that the shutters 12 are protecting to access the storm bar device 13. More specifically, the occupant 60 disengages the fasteners 20, 58 to release the backing member 17 and the retention bracket 18 from each other and from the mounting brackets 16A, 16B. With the shutter assembly 10 unlocked, the occupant 60 can then easily force the shutters 12 from the closed position into the open position and exit the dwelling 14 as necessary.

One skilled in the art would now know that modifications to the preferred embodiment of the invention could include the omission of the elongated backing member 17 although this could potentially weaken the resistance of the shutters 12 from blowing into the opening or toward the window during high or hurricane wind scenarios. In such a modification, the slot 50 defined between the legs 46, 48 of each mounting bracket 16A, 16B, receives the respective lower and upper ends of the locking portion 28. Hence, the first and second support legs 46, 48, and not the first and second flange sections 52, 54, maintain the shutters 12 spaced from the dwelling 14 when the shutters 12 are in the closed position.

Moreover, one skilled in the art would now know that the mounting brackets 16A, 16B could be omitted and the ends of the elongated backing member 17 could be mounted directly to the sill and header. Furthermore, the locking portion 28 and the U-channel section 55 could be interchanged between the exterior retention bracket 18 and the interior backing member 17. However, the fasteners 20 would then be installed from the outside of the dwelling 14 and not the inside.

It is preferred that the shutters 12 of the shutter assembly 10 are impact resistant when used in combination with the lockable storm bar device 13. Such impact-resistant shutters are commonly referred to as storm-proof or storm-rated shutters. One such shutter is disclosed in commonly assigned U.S. patent application Ser. No. 10/264,476, now U.S. Pat. No. 7,174,683 issued Feb. 13, 2007, entitled "Impact-Resistant Shutter Assembly" which was filed on the same day as the parent of this application, the disclosure of which is herein incorporated by reference in its entirety. However, the shutter assembly 10 of the subject invention may use any type of shutter 12, including conventional aluminum shutters that are primarily utilized for decorative purposes and are not impact-resistant. The security bar device 13 is preferably made of metal for strength and can be made of aluminum and/or stainless steel to resist corrosion in salty environments.

As best illustrated in FIG. 8, an alternative shutter assembly 10' is disclosed wherein like elements have the same identifying numerals of the first embodiment except with the addition of a prime symbol. A backing member 17' of the shutter assembly 10' has a notch or channel 30' at an upper end that receives a pin or rod 64 extending across a slot 50' of the mounting bracket 16B'. The ends of the rod 64 are supported by respective legs 46', 48' of the mounting bracket 16B' that define in-part the slot 50'. The arrow identified as 62 in FIG. 8 represents the direction of engagement of the backing member 17' to the upper bracket 16B'.

Shutter assembly 10' is beneficial when used in a single hung window application, wherein the upper mounting bracket 16B' is inaccessible from inside the dwelling with the shutters in their closed position because of interference by the upper non-moving window pane. When assembly 10' is used in this application, the occupant 60 simply raises the lower pane of the single hung window and disengages a lower fastener 20' from the lower mounting bracket 16A' to unlock the shutter assembly 10'. After removing pin 20', the occupant pulls the lower end of the backing member 17' inwardly toward oneself and then downward to release the top end from the pin 64.

Although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

What is claimed is:

1. A shutter assembly for protectively covering an opening of a dwelling, the shutter assembly comprising:

at least one shutter adapted to be mounted to the exterior of the dwelling and constructed and arranged to move between a closed position wherein the shutter covers at least in-part the opening and an open position wherein the shutter is clear of the opening; and a security bar device adapted to be engaged releasably to the dwelling, the security bar device having:

an elongated retention portion located outward from the at least one shutter and with respect to the dwelling when in the closed position, an elongated member having an elongated flange section being in contact with the at least one shutter when in the closed position, the elongated member disposed parallel to the retention portion and located inward from the at least one shutter when in the closed position, with a portion of the shutter being located between the retention portion and the elongated member, the elongated member having an elongated side wall projecting laterally outward from the elongated flange section and inward with respect to the dwelling, and an elongated locking portion disposed parallel to the retention portion and spanning laterally between the retention portion and the elongated member for releasably engaging the retention portion and the elongated member together, the retention portion and the locking portion formed as one unitary piece, the side wall releasably engaged to the locking portion;

a first aperture in the locking portion;

a second aperture in the side wall; and a fastener extending through the first and second apertures for engaging the locking portion to the side wall.

2. The shutter assembly set forth in claim 1 further comprising:

a first support leg of the security bar device adapted to be projecting outward from the dwelling and into the opening; and a third aperture in the support leg wherein the fastener extends through the third aperture for engaging the side wall to the dwelling.

3. The shutter assembly set forth in claim 2 further comprising:

a first end of the elongated side wall having the second aperture;

an opposite second end of the elongated side wall; and a second support leg of the security bar device adapted to be projecting from the dwelling structure in the opening and projecting toward the first support leg for releasable engagement to the second end.

4. The shutter assembly set forth in claim 3 further comprising:

a notch in the second end opened longitudinally outward with respect to the side wall; and a pin projecting transversely outward from the second support leg and slideably received in the notch when the at least one shutter is in the closed position.

5. A shutter assembly for protectively covering an opening of a dwelling, the shutter assembly comprising:

a first shutter and a second shutter both adapted to be mounted to the exterior of the dwelling and constructed and arranged to move between a closed position wherein the first and second shutters cover the opening and an open position wherein the first and second shutters are clear of the opening, a gap defined between the first and second shutters when in the closed position;

a security bar device adapted to be engaged releasably to the dwelling, the storm bar device having:

an elongated retention portion co-extending with the gap and located outward from the first and second shutters with respect to the dwelling when the first and second shutters are in the closed position, an elongated member disposed parallel to the retention portion and located inward from the first and second shutters with respect to the dwelling when the first and second shutters are in the closed position, with first and second portions of the respective first and second shutters being located between the retention portion and the elongated member, the elongated member defining a channel and having first and second walls, the first and second side walls of the elongated member defining in-part the channel and spaced laterally away from one-another, the channel extending along the gap and communicating laterally outward with the gap, an elongated locking portion co-extending with the retention portion, disposed in-part in the gap, and being releasably engaged between the retention portion and the elongated member, the locking portion projecting laterally into the channel for engagement to the elongated member, and a mounting bracket having a plate adapted to be engaged to the dwelling, first and second legs adapted to be projecting into the opening from the plate, and a slot defined by the first and second legs and the plate, and wherein ends of the locking portion and elongated member extend transversely into the slot for releasable engagement to the first and second legs;

a first aperture in the locking portion;

a second aperture in the first side wall;

a third aperture in the second side wall;

a fourth aperture in the first leg;

a fifth aperture in the second leg; and a fastener extending through the first, second, third, fourth, and fifth apertures for engaging the locking portion to the first and second side walls.

6. The shutter assembly set forth in claim 5 further comprising:

a first end of the elongated member having the second and third apertures;

an opposite second end of the elongated member; and third and fourth support legs of the security bar device adapted to be projecting from the dwelling structure in the opening and toward the first and second support legs for releasable engagement to the second end when the second end is in a second slot defined between the third and fourth legs.

7. The shutter assembly set forth in claim 6 further comprising:

a notch in the second end opened longitudinally outward with respect to the elongated member; and a pin spanning between the third and fourth legs in the second slot and slideably received in the notch during engagement of the elongated member to the dwelling.

8. A shutter assembly for protectively covering an opening of a dwelling, the shutter assembly comprising:

at least one shutter mounted to the dwelling and spaced over the opening when closed;

an elongated member traversing the opening and engaged releasably to the dwelling, the elongated member having a first end and an opposite second end;

a first leg projecting outward from the dwelling and into the opening;

a second leg projecting outward from the dwelling, in the opening, and toward the first leg;

a rod projecting outward from the second leg;

a notch in the second end for sliding receipt of the rod to prevent inward movement of the elongated member with respect to the dwelling;

first and second apertures in the respective first end and first leg; and a releasable fastener extending through the first and second apertures.

9. A shutter assembly for protectively covering an opening of a dwelling, the shutter assembly comprising:

at least one shutter adapted to be mounted to the dwelling and constructed and arranged to move between a closed position wherein the shutter covers at least in-part the opening and an open position wherein the shutter is clear of the opening; and a security bar device adapted to be engaged releasably to the dwelling, the security bar device having:

an elongated retention portion located outward from the at least one shutter and with respect to the dwelling when in the closed position, an elongated member having an elongated flange section being in contact with the at least one shutter when in the closed position, the elongated member disposed parallel to the retention portion and located inward from the at least one shutter when in the closed position, with a portion of the shutter being located between the retention portion and the elongated member, the elongated member having an elongated side wall projecting laterally outward from the elongated flange section and inward with respect to the dwelling, and an elongated locking portion disposed parallel to the retention portion and spanning laterally between the retention portion and the elongated member for releasably engaging the retention portion and the elongated member together, the retention portion and the locking portion formed as one unitary piece, the side wall releasably engaged to the locking portion;

a first aperture in the locking portion;

a second aperture in the side wall; and a fastener extending through the first and second apertures for engaging the locking portion to the side wall.

10. The shutter assembly set forth in claim 9 further comprising:

a first support leg of the security bar device adapted to be projecting outward from the dwelling and into the opening; and a third aperture in the support leg wherein the fastener extends through the third aperture for engaging the side wall to the dwelling.

11. The shutter assembly set forth in claim 10 further comprising:

a first end of the elongated side wall having the second aperture;

an opposite second end of the elongated side wall; and a second support leg of the security bar device adapted to be projecting from the dwelling structure in the opening and projecting toward the first support leg for releasable engagement to the second end.

12. The shutter assembly set forth in claim 11 further comprising:

a notch in the second end opened longitudinally outward with respect to the side wall; and a pin projecting transversely outward from the second support leg and slideably received in the notch when the at least one shutter is in the closed position.

13. A shutter assembly for protectively covering an opening of a dwelling, the shutter assembly comprising:

a first shutter and a second shutter both adapted to be mounted to the dwelling and constructed and arranged to move between a closed position wherein the first and second shutters cover the opening and an open position wherein the first and second shutters are clear of the opening, a gap defined between the first and second shutters when in the closed position;

a security bar device adapted to be engaged releasably to the dwelling, the storm bar device having:

an elongated retention portion co-extending with the gap and located outward from the first and second shutters with respect to the dwelling when the first and second shutters are in the closed position, an elongated member disposed parallel to the retention portion and located inward from the first and second shutters with respect to the dwelling when the first and second shutters are in the closed position, with first and second portions of the respective first and second shutters being located between the retention portion and the elongated member, the elongated member defining a channel and having first and second walls, the first and second side walls of the elongated member defining in-part the channel and spaced laterally away from one-another, the channel extending along the gap and communicating laterally outward with the gap, an elongated locking portion co-extending with the retention portion, disposed in-part in the gap, and being releasably engaged between the retention portion and the elongated member, the locking portion projecting laterally into the channel for engagement to the elongated member, and a mounting bracket having a plate adapted to be engaged to the dwelling, first and second legs adapted to be projecting into the opening from the plate, and a slot defined by the first and second legs and the plate, and wherein ends of the locking portion and elongated member extend transversely into the slot for releasable engagement to the first and second legs;

a first aperture in the locking portion;

a second aperture in the first side wall;

a third aperture in the second side wall;

a fourth aperture in the first leg;

a fifth aperture in the second leg; and a fastener extending through the first, second, third, fourth, and fifth apertures for engaging the locking portion to the first and second side walls.

14. The shutter assembly set forth in claim 13 further comprising:

a first end of the elongated member having the second and third apertures;

an opposite second end of the elongated member; and third and fourth support legs of the security bar device adapted to be projecting from the dwelling structure in the opening and toward the first and second support legs for releasable engagement to the second end when the second end is in a second slot defined between the third and fourth legs.

15. The shutter assembly set forth in claim 14 further comprising:

a notch in the second end opened longitudinally outward with respect to the elongated member; and a pin spanning between the third and fourth legs in the second slot and slideably received in the notch during engagement of the elongated member to the dwelling.

* * * * *